US008985050B2

(12) United States Patent
Von Gutfeld

(10) Patent No.: US 8,985,050 B2
(45) Date of Patent: Mar. 24, 2015

(54) SUBSTRATE LASER OXIDE REMOVAL PROCESS FOLLOWED BY ELECTRO OR IMMERSION PLATING

(75) Inventor: Robert J Von Gutfeld, New York, NY (US)

(73) Assignee: The Trustees of Columbia University in the City of New York, New York, NY (US)

( * ) Notice: Subject to any disclaimer, the term of this patent is extended or adjusted under 35 U.S.C. 154(b) by 376 days.

(21) Appl. No.: 12/940,703

(22) Filed: Nov. 5, 2010

(65) Prior Publication Data

US 2011/0104396 A1 May 5, 2011

Related U.S. Application Data

(60) Provisional application No. 61/266,370, filed on Dec. 3, 2009, provisional application No. 61/258,528, filed on Nov. 5, 2009.

(51) Int. Cl.

| | |
|---|---|
| ***B05C 1/06*** | (2006.01) |
| ***B05C 1/04*** | (2006.01) |
| ***B05D 3/06*** | (2006.01) |
| ***C25D 17/00*** | (2006.01) |
| ***C25D 5/10*** | (2006.01) |
| ***C25D 5/38*** | (2006.01) |
| ***C25D 5/36*** | (2006.01) |

(Continued)

(52) U.S. Cl.

CPC .. *C25D 5/34* (2013.01); *B05D 3/06* (2013.01); *B05C 1/06* (2013.01); *C25D 5/36* (2013.01); *C25D 5/38* (2013.01); *C25D 5/44* (2013.01); *C25D 17/00* (2013.01)

USPC ..... 118/620; 205/205

(58) Field of Classification Search

None

See application file for complete search history.

(56) References Cited

U.S. PATENT DOCUMENTS

| | | | | |
|---|---|---|---|---|
| 2,964,453 | A * | 12/1960 | Garn et al. | 205/772 |
| 3,582,478 | A * | 6/1971 | Kelly et al. | 205/88 |
| 3,790,738 | A | 2/1974 | Laub et al. | |

(Continued)

FOREIGN PATENT DOCUMENTS

| | | |
|---|---|---|
| CN | 1793434 | 6/2006 |
| JP | 60-204899 A | 10/1985 |

(Continued)

OTHER PUBLICATIONS

U.S. Appl. No. 12/040,378, Dec. 11, 2012 Non-Final Office Action.

(Continued)

*Primary Examiner* — Dah-Wei D Yuan
*Assistant Examiner* — Jethro M Pence
(74) *Attorney, Agent, or Firm* — Baker Botts, LLP

(57) ABSTRACT

Method of ablating the surface of a substrate including providing a dry substrate and an electrolyte source, ablating the surface of the dry substrate to at least partially remove a native oxide layer, and immersing the ablated dry substrate in the electrolyte source, in which the dry substrate is ablated prior to being introduced into the electrolyte source. Also provided is a method of ablating the surface of a substrate that includes providing a dry substrate and an electrolyte, depositing a portion of the electrolyte on the substrate at a thickness of less than 10 microns and ablating the surface of the substrate with the electrolyte applied thereon. System for use in the ablation of the surface of a substrate are also provided.

7 Claims, 10 Drawing Sheets

(51) Int. Cl.
*C25D 5/34* (2006.01)
*C25D 5/44* (2006.01)

(56) References Cited

U.S. PATENT DOCUMENTS

| | | | | | |
|---|---|---|---|---|---|
| 4,098,655 | A | * | 7/1978 | Ward et al. | 205/85 |
| 4,169,770 | A | * | 10/1979 | Cooke et al. | 205/139 |
| 4,217,183 | A | * | 8/1980 | Melcher et al. | 205/92 |
| 4,229,264 | A | * | 10/1980 | Graunke | 205/789.5 |
| 4,283,259 | A | * | 8/1981 | Melcher et al. | 205/646 |
| 4,348,263 | A | | 9/1982 | Draper et al. | |
| 4,395,320 | A | * | 7/1983 | Kasashima et al. | 204/206 |
| 4,432,855 | A | * | 2/1984 | Romankiw et al. | 204/207 |
| 4,497,692 | A | | 2/1985 | Gelchinski et al. | |
| 4,629,539 | A | * | 12/1986 | Imai | 205/667 |
| 4,895,633 | A | * | 1/1990 | Seto et al. | 204/207 |
| 4,904,340 | A | | 2/1990 | Miracky et al. | |
| 4,917,774 | A | | 4/1990 | Fisher | |
| 4,919,769 | A | * | 4/1990 | Lin | 205/138 |
| 5,057,184 | A | | 10/1991 | Gupta et al. | |
| 5,202,291 | A | | 4/1993 | Charvat et al. | |
| 5,245,847 | A | | 9/1993 | Bando et al. | |
| 5,279,702 | A | | 1/1994 | Douglas | |
| 5,292,418 | A | | 3/1994 | Morita et al. | |
| 5,296,375 | A | | 3/1994 | Kricka et al. | |
| 5,338,416 | A | | 8/1994 | Mlcak et al. | |
| 5,364,510 | A | | 11/1994 | Carpio | |
| 5,378,343 | A | | 1/1995 | Kounaves et al. | |
| 5,704,493 | A | | 1/1998 | Fujikawa et al. | |
| 5,906,723 | A | | 5/1999 | Mathies et al. | |
| 5,928,880 | A | | 7/1999 | Wilding et al. | |
| 5,932,799 | A | | 8/1999 | Moles | |
| 6,042,712 | A | | 3/2000 | Mathieu | |
| 6,110,354 | A | | 8/2000 | Saban et al. | |
| 6,159,353 | A | | 12/2000 | West et al. | |
| 6,165,630 | A | | 12/2000 | Gehlhaar et al. | |
| 6,280,602 | B1 | | 8/2001 | Robertson | |
| 6,319,834 | B1 | * | 11/2001 | Erb et al. | 438/687 |
| 6,334,980 | B1 | | 1/2002 | Hayes et al. | |
| 6,391,559 | B1 | | 5/2002 | Brown et al. | |
| 6,423,207 | B1 | | 7/2002 | Heidari et al. | |
| 6,509,085 | B1 | | 1/2003 | Kennedy | |
| 6,521,118 | B1 | | 2/2003 | Starvetsky et al. | |
| 6,532,642 | B1 | | 3/2003 | Wingo | |
| 6,787,012 | B2 | | 9/2004 | Stanbery | |
| 6,936,167 | B2 | | 8/2005 | Hobbs et al. | |
| 7,079,760 | B2 | | 7/2006 | Hamelin et al. | |
| 7,192,559 | B2 | | 3/2007 | Chow et al. | |
| 2002/0046949 | A1 | | 4/2002 | Nakamura et al. | |
| 2002/0125142 | A1 | | 9/2002 | Sun et al. | |
| 2002/0195345 | A1 | | 12/2002 | Bentsen et al. | |
| 2003/0008473 | A1 | | 1/2003 | Sakaguchi et al. | |
| 2003/0029722 | A1 | | 2/2003 | Erdosy et al. | |
| 2004/0166504 | A1 | * | 8/2004 | Rossier et al. | 435/6 |
| 2005/0173253 | A1 | | 8/2005 | Huang | |
| 2005/0224359 | A1 | | 10/2005 | Su et al. | |
| 2005/0241948 | A1 | | 11/2005 | Han et al. | |
| 2006/0003579 | A1 | | 1/2006 | Sir | |
| 2008/0142367 | A1 | * | 6/2008 | Von Gutfeld et al. | 205/92 |
| 2008/0245674 | A1 | * | 10/2008 | von Gutfeld et al. | 205/640 |
| 2008/0264801 | A1 | * | 10/2008 | West et al. | 205/775 |
| 2008/0299780 | A1 | | 12/2008 | Elliott et al. | |
| 2009/0081386 | A1 | * | 3/2009 | Von Gutfeld et al. | 427/597 |
| 2010/0084268 | A1 | * | 4/2010 | Pierce et al. | 204/403.14 |
| 2010/0084286 | A1 | | 4/2010 | West | |
| 2011/0042201 | A1 | * | 2/2011 | Von Gutfeld et al. | 204/200 |

FOREIGN PATENT DOCUMENTS

| | | | |
|---|---|---|---|
| JP | 04-066679 | A | 3/1992 |
| JP | 2011071700 | | 4/2011 |
| WO | WO9510040 | | 4/1995 |
| WO | WO2006086407 | | 8/2006 |
| WO | WO2006110437 | | 10/2006 |

OTHER PUBLICATIONS

U.S. Appl. No. 12/040,378, Nov. 27, 2012 Amendment and Request for Continued Examination (RCE).
U.S. Appl. No. 12/208,287, Dec. 28, 2012 Response to Non-Final Office Action.
U.S. Appl. No. 12/040,378, Apr. 27, 2012 Response to Non-Compliant.
U.S. Appl. No. 12/040,378, Apr. 10, 2012 Notice of Non-Compliant.
U.S. Appl. No. 12/478,591, Apr. 23, 2012 Amendment and Request for Continued Examination (RCE).
U.S. Appl. No. 11/767,461, Jan. 26, 2012 Final Office Action.
U.S. Appl. No. 11/867,399, Feb. 21, 2012 Amendment and Request for Continued Examination (RCE).
U.S. Appl. No. 12/478,591, Jul. 9, 2012 Notice of Allowance.
U.S. Appl. No. 12/040,378, Jun. 28, 2012 Final Office Action.
U.S. Appl. No. 12/208,287, Jun. 29, 2012 Non-Final Office Action.
U.S. Appl. No. 11/767,461, Jul. 20, 2012 Amendment and Request for Continued Examination (RCE).
U.S. Appl. No. 11/767,461, Jul. 6, 2012 Advisory Action.
U.S. Appl. No. 11/767,461, Jun. 26, 2012 Response to Final Office Action.
U.S. Appl. No. 11/867,399, Aug. 21, 2012 Non-Final Office Action.
U.S. Appl. No. 11/767,461, Oct. 3, 2012 Final Office Action.
Darling, et al., "Integration of microelectrodes with etched microchannles for in-stream electrochemical analysis", *Micro Total Analysis Systems*, pp. 105-108 (1998).
U.S. Appl. No. 11/767,461, Nov. 30, 2011 Response to Non-Final Office Action.
U.S. Appl. No. 12/478,591, Nov. 23, 2011 Final Office Action.
U.S. Appl. No. 12/478,591, Nov. 10, 2011 Response to Non-Final Office Action.
U.S. Appl. No. 12/040,378, Dec. 22, 2011 Non-Final Office Action.
U.S. Appl. No. 11/767,461, Apr. 2, 2013 Notice of Appeal.
U.S. Appl. No. 11/767,461, Feb. 11, 2013 Applicant Initiated Interview Summary.
U.S. Appl. No. 11/767,461, Feb. 7, 2013 Response to Final Office Action.
U.S. Appl. No. 11/867,399, Jan. 28, 2013 Response to Non-Final Office Action.
U.S. Appl. No. 11/867,399, Oct. 19, 2011 Final Office Action.
U.S. Appl. No. 11/867,399, Aug. 24, 2011 Response to Non-Final Office Action.
U.S. Appl. No. 11/867,399, Mar. 24, 2011 Non-Final Office Action.
U.S. Appl. No. 12/040,378, Oct. 10, 2011 Amendment and Request for Continued Examination (RCE).
U.S. Appl. No. 12/040,378, Oct. 4, 2011 Advisory Action.
U.S. Appl. No. 12/040,378, Sep. 20, 2011 Response to Final Office Action.
U.S. Appl. No. 12/040,378, Jun. 9, 2011 Final Office Action.
T. Kikuchi et al., "Local surface modification of aluminum by laser irradiation", *Electrochimica Acta*, 2001: 225-234.
Lowenheim, F., Ed. John Wiley & Sons Inc.; Modern Electroplating; (3rd Edition); 1974: 591-625.
O. Mallory, Glenn; Hajdu, Juan B.; Fundamentals and Applications; American Electroplaters and Surface Finishers Society; 1990: 193-204.
Ogden et al., "Cylic Voltaammetric Stripping Analysis of Copper Plating Baths", *Applications of Polarization Measurements in the Control of Metal Deposition*, 1984: 229-240.
Wills et al., "Laser micromachining of indium tin oxide films on polymer substrates by laser-induced delamination", *J. Phys. D: Appl. Phys.*, 42 (2009) 045306 (8pp).
U.S. Appl. No. 12/040,378, Mar. 28, 2011 Response to Non-Final Office Action.
U.S. Appl. No. 12/040,378, Oct. 28, 2010 Non-Final Office Action.
U.S. Appl. No. 11/767,461, Aug. 9, 2011 Non-Final Office Action.
U.S. Appl. No. 12/478,591. Aug. 10, 2011 Non-Final Office Action.

* cited by examiner

Plating to minimize deformation of sample; A very thin layer of electrolyte seems to limit deformation–fine sponge is likely to be better than Q–tip

SUBSTRATE LASER OXIDE REMOVAL PROCESS FOLLOWED BY ELECTRO OR IMMERSION PLATING

CROSS REFERENCE TO RELATED APPLICATIONS

This application claims the benefit of U.S. Provisional Application No. 61/266,370, filed Dec. 3, 2009 and U.S. Provisional Application No. 61/258,528, filed Nov. 5, 2009, each of which is incorporated by reference in their entirety herein, and from which priority is claimed.

FIELD

The present application relates to systems and methods for ablation of a substrate. In one aspect, the laser travels a very short distance (e.g., less than 10 microns) through the electrolyte before contacting the substrate. In an another aspect, the laser ablates a dry substrate in a normal air environment, followed by immersion in an electrolyte solution (e.g., immersion within a very short time).

BACKGROUND

Laser oxide removal processes for plating (LORP) is a known technique in which a laser is directed to a substrate to be plated while the substrate is immersed in the plating solution (e.g., an electrolyte solution). However, LORP suffers from certain drawbacks, particularly when used in the UV spectral range. For example, it can be necessary to use a relatively long focal length lens in order to avoid damage to the cell window, which is located in the front part of the tank or electrolytic cell. The use of a long focal length lens results in the laser light having a relatively long distance to travel in the electrolyte before the beam converges, resulting in substantial optical attenuation which, in turn, makes the light less efficient for oxide removal. In contrast, the light incident on a sample that removes the oxide should be maximized, by minimizing losses between the laser output and the region the laser strikes for absorption by the substrate, and increasing the area of oxide removal per unit of incident optical energy/sq-cm.

There remains a need for improved LORP techniques that simplifies existing methods and overcomes disadvantages of current LORP processes.

SUMMARY

One aspect of the presently disclosed subject matter provides a method of ablating the surface of a substrate. The method includes providing a dry substrate and an electrolyte source, ablating the surface of the dry substrate to at least partially remove a native oxide layer, and immersing the ablated dry substrate in the electrolyte, in which the dry substrate is ablated prior to being introduced into the electrolyte. In one embodiment, the method can further include plating the substrate that was immersed in the electrolyte with a metal.

The substrate which is dry ablated can be selected from aluminum, titanium, tungsten, tantalum, molybdenum, and stainless steel. The electrolyte source can be selected from a silver solution, a gold solution, a copper solution, a nickel solution. The laser can have a frequency in the ultraviolet (UV) to infrared (IR) spectral range.

In one embodiment, the substrate is immersed in the electrolyte source immediately after being ablated. In one embodiment, the time between ablating the surface of the dry substrate and immersing the ablated dry substrate is less than one second, or less than 100 milliseconds.

The present application also provides a system for use in the ablation of the surface of a substrate. The system includes a laser to provide a laser beam, a substrate, an electrolyte, and a conveyor to direct the substrate towards the electrolyte, in which the laser and substrate are configured such that the laser beam contacts the substrate in a dry form prior to being introduced to the electrolyte.

The source of electrolyte can be, for example, a container of the electrolyte. The container of the electrolyte contains an electrolyte air interface, and the distance between where the laser beam strikes the substrate and the electrolyte air interface can be from about 5 mm to about 15 mm. Alternatively, the source of electrolyte can be a wetting pad, and the distance between where the laser beam strikes the substrate and the wetting pad is from about 5 mm to about 15 mm.

Another aspect of the presently disclosed subject matter provides a method of ablating the surface of a substrate, the method including providing a dry substrate and an electrolyte source, depositing a portion of the electrolyte source on the substrate at a thickness of less than 10 microns, and ablating the surface of the substrate with the electrolyte applied thereon. According to one embodiment, the substrate can be introduced to a second source of electrolyte after the surface of the substrate is ablated. The second source of electrolyte can be, for example, a container of electrolyte or a wetting pad.

According to another embodiment, a system for use in the ablation of the surface of a substrate is provided that includes a laser to provide a laser beam, a substrate, a wetting pad that includes an electrolyte, and a conveyor configured to direct the substrate towards the wetting pad in which the laser and substrate are configured such that the laser beam contacts the substrate prior to being introduced to the source of electrolyte. The wetting pad and sponge can be configured such that the wetting pad deposits the electrolyte on the substrate at a thickness of from about 200 nm to about 10 microns.

BRIEF DESCRIPTION OF THE DRAWINGS

Further features of the disclosed subject matter, its nature, and various advantages will be more apparent from the following detailed description of the embodiments and the accompanying drawings, wherein like reference characters represent like elements throughout, and in which.

DETAILED DESCRIPTION

The Figures further illustrate how ablation can be carried out in air if the time between laser strike and movement into the electrolyte is sufficiently short. As noted above, in certain embodiments, the laser does not pass through the cell structure to strike the sample.

Figure 1:
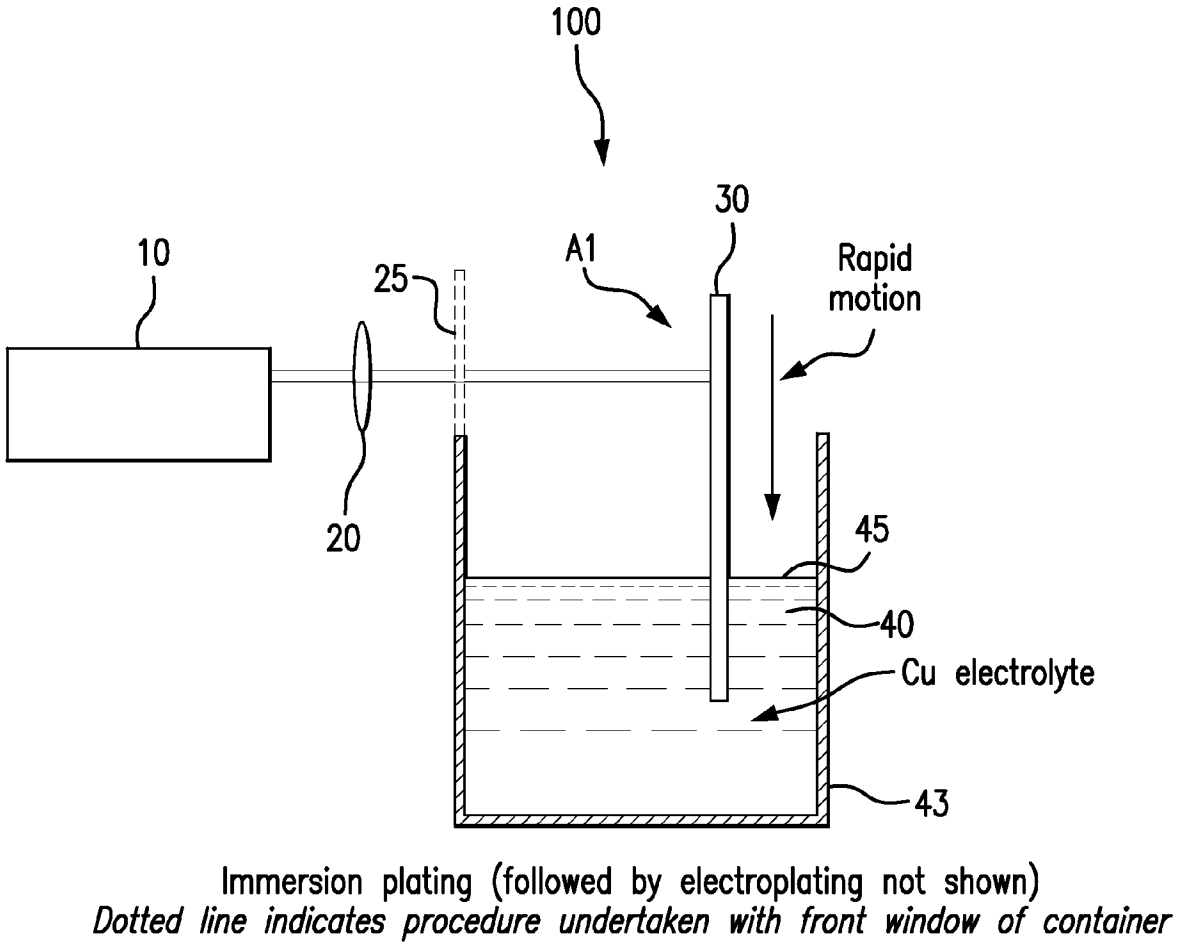
FIG. 1 is a schematic illustration of an immersion plating system that employs dry ablation to remove a native oxide layer from a substrate.

FIG. 1 depicts an immersion plating system (100) for use in the ablation of the surface of a substrate to at least partially remove a native oxide layer according to one non-limiting embodiment of the present application. Such immersion plating can be followed by an electroplating process (such as described, for example, in FIG. 5).

With reference to FIG. 1, a laser (10) is provided to provide laser pulses. The laser can provide, for example, UV to IR and milliseconds to femtosecond sets of laser pulses. The laser is focused via a focal lens (20) and directed through the front window (25) of the container holding the electrolyte solution, as shown by the dotted line in FIG. 1. Alternatively, the system can be employed without a front window. In this embodiment, a substrate such as an aluminum substrate (30) is provided, for which it is desired to remove a native oxide layer that is found thereon. The aluminum substrate is introduced via rapid motion to a copper electrolyte solution (40) shortly after being introduced to the laser, and subsequently removed from the solution.

In the particular embodiment shown in FIG. 1, the electrolyte is housed in a container (43), and the container contains an electrolyte air interface (45) to which the dry ablated substrate is introduced. The distance between where the laser contacts the substrate and the electrolyte air interface can be less than 30 mm, and in one embodiment is a distance from about 5 mm to about 15 mm (e.g., 10 mm). The exact mechanism for introducing the aluminum substrate to the copper electrolyte solution is not necessarily limited, and, while not depicted in FIG. 1, can be accomplished by a conveyor using methods that can be determined by persons of ordinary skill in the art.

While some re-oxidation in air may occur, at least in theory, "immediately" after oxide removal in air, it can be made small enough to be insignificant for the purposes of plating as long as the time between the ablated region reaching the electrolyte is small, (e.g., <~1 second, preferably shorter). In certain embodiments, the time between ablated region reaching the electrolyte is less than 0.5 seconds, or less than 0.25 seconds, or less than 0.10 seconds.

Figure 2:
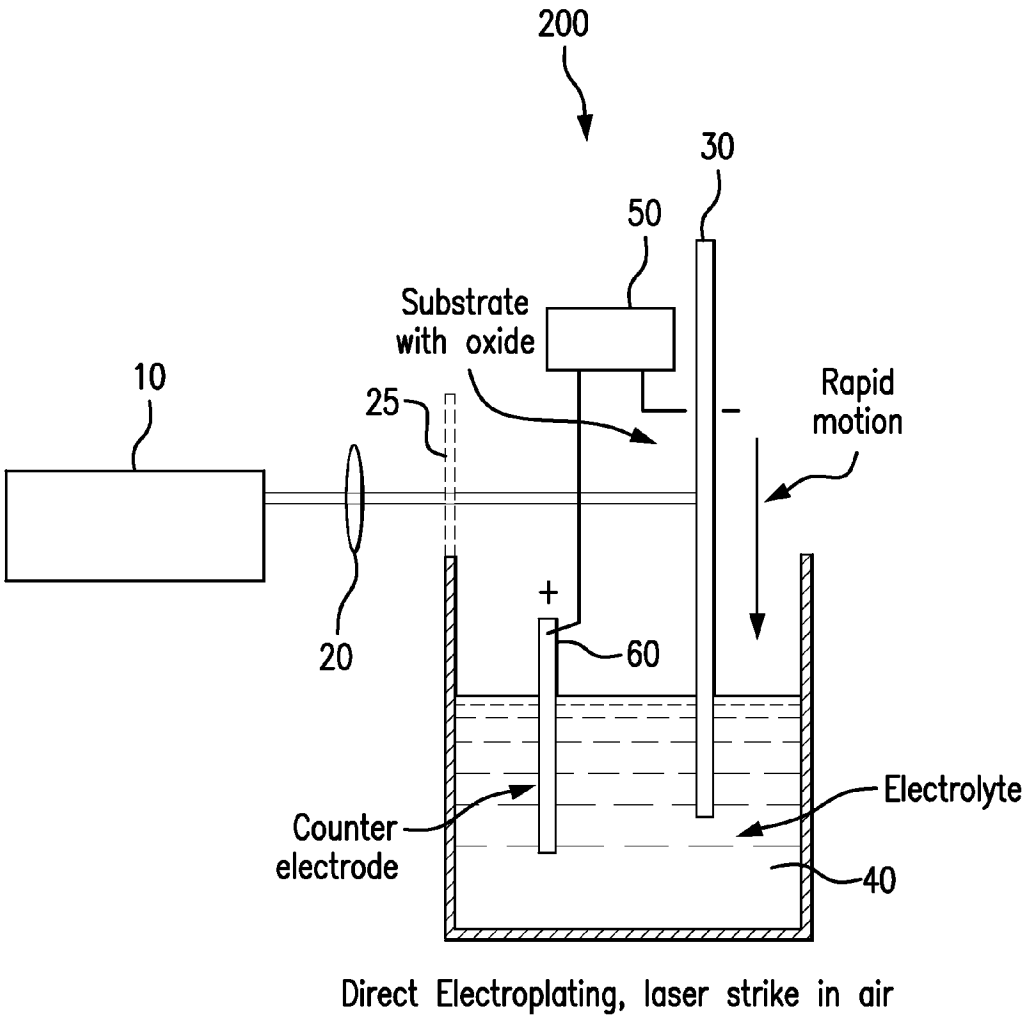
FIG. 2 is a schematic illustration of an electroplating system that employs dry ablation to remove a native oxide layer from a substrate.

FIG. 2 depicts an alternative embodiment, in which a system (200) is provided to provide direct electroplating after dry ablation of a native oxide layer. A laser (10), focal lens (20), front window of a container (25), substrate with a native oxide layer (30) and electrolyte solution (40) is provided as in FIG. 1. In this embodiment, a battery or other power supply (50) is provided and in communication with an anode or counter electrode (60) and the substrate, in which the substrate serves as the cathode. Optionally, the counter electrode is omitted. Direct electroplating occurs after the dry substrate is ablated with the laser to at least partially remove a native oxide layer.

Figure 3:
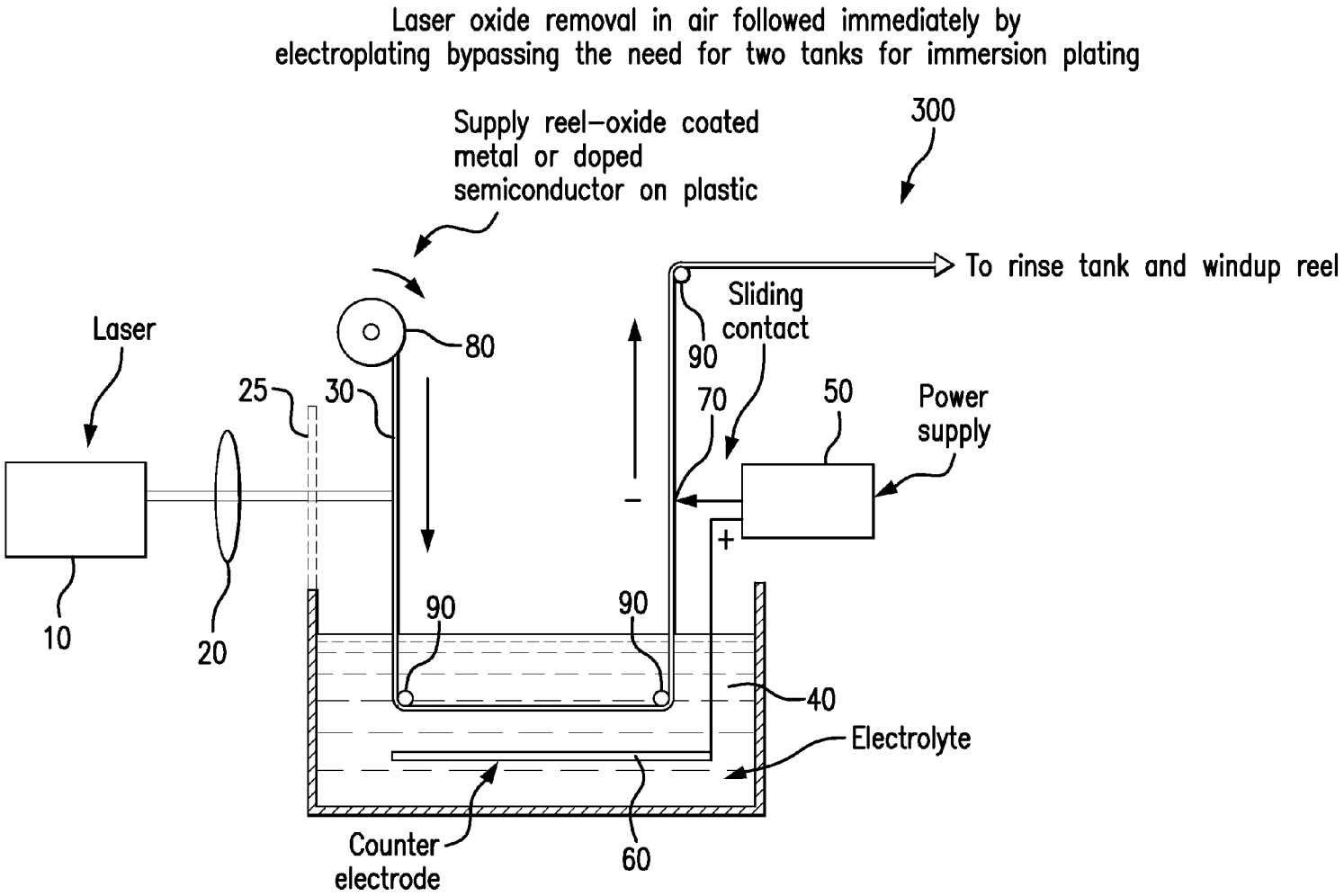
FIG. 3 is a schematic illustration of a laser oxide removal process that is followed immediately by electroplating.

FIG. 3 also depicts a system (300) for laser oxide removal in air followed immediately by electroplating, in which the need for two tanks for immersion plating can be bypassed. As in FIG. 2, a laser (10), focal lens (20), front window of a container (25), substrate with a native oxide layer (30) and electrolyte solution (40) is provided. A power supply (50), and counter electrode (60) is also provided as in FIG. 2. FIG. 3 depicts the engagement of the power supply with the substrate via a sliding contact (70).

FIG. 3 illustrates that a conveyor that includes a supply reel (80) can be provided to direct the substrate to the laser, and then the electrolyte solution. The supply reel contains the substrate material with a native oxide layer to be removed by the laser. After electroplating has occurred, the substrate is directed to a rinse tank and windup reel (not shown), which is facilitated via the guides (90).

Although the conveyor disclosed in this particular embodiment employs supply reels and guides, other conveyors can be employed in accordance with the disclosed subject matter. For example, a motor driven conveyor could be employed, or the conveyor can be configured such that the substrate is lowered in the electrolyte with manual assistance and optionally the aid of, for example, one or more guides and/or support blocks or the like.

Figure 4:
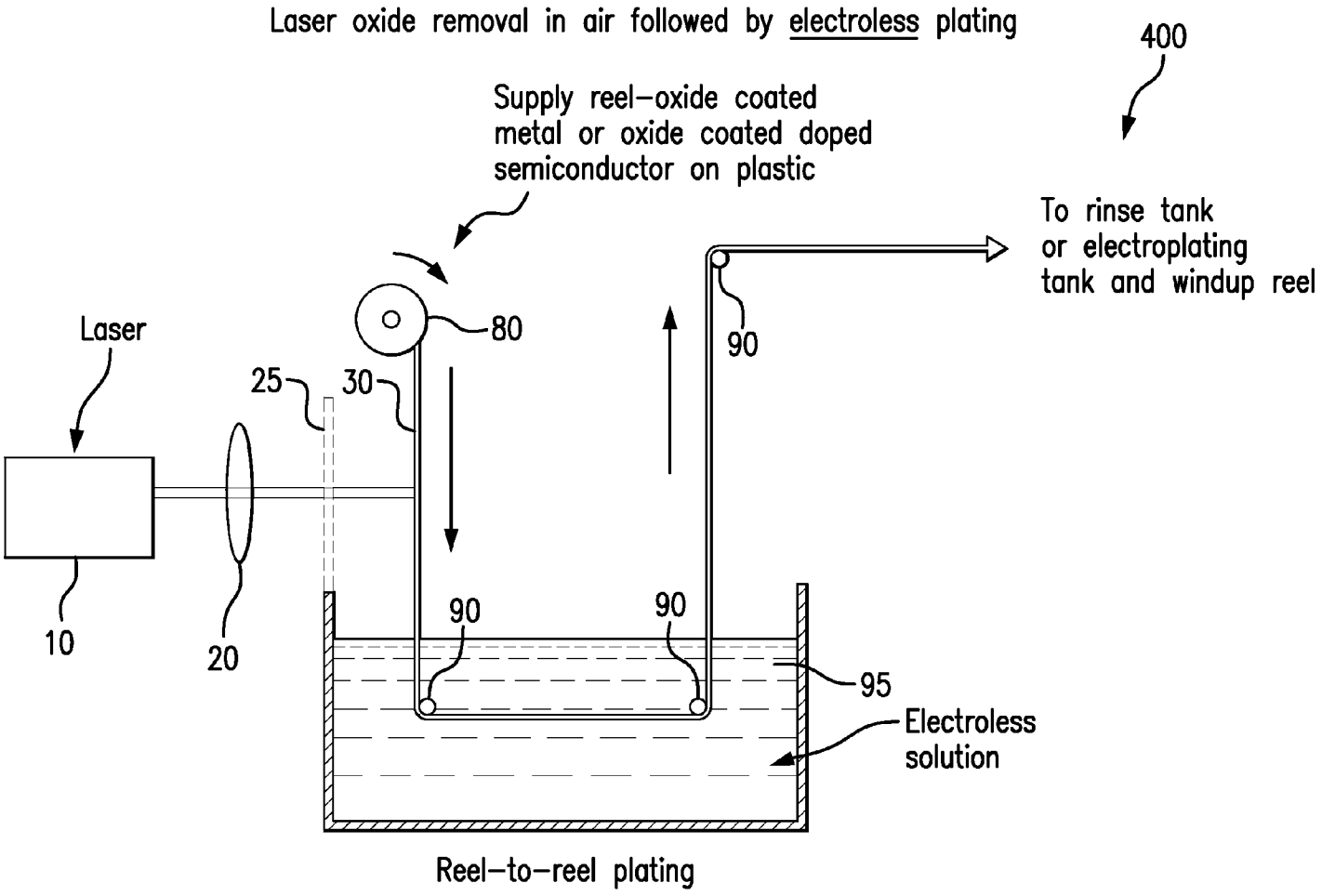
FIG. 4 is a schematic illustration of a laser oxide removal process that is followed immediately by electroless plating utilizing a reel to reel plating system.

A system (400), according to another non-limiting embodiment, that provides laser oxide removal in air followed by electroless plating is depicted in FIG. 4. As in FIG. 3, a laser (10), focal lens (20), front window of a container (25), substrate with a native oxide layer (30), supply reel (80) and guides (90) are provided. An electroless solution (95) is provided to plate the substrate after the laser has removed the native oxide layer formed thereon. Electroless solutions can be advantageously employed, for example, to treat bumpy surfaces or in applications in which finer detail is desired.

Figure 5:
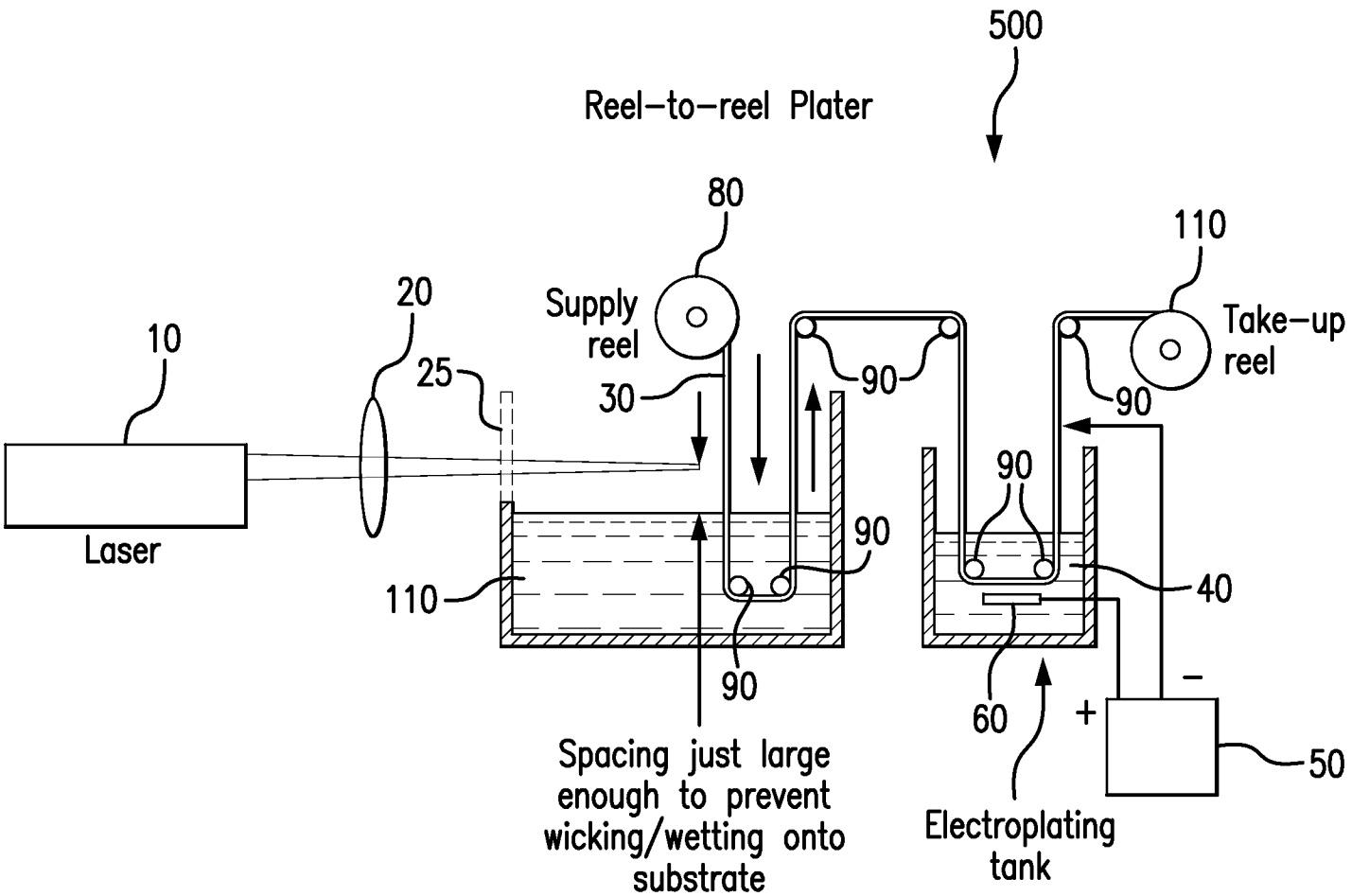
FIG. 5 is a schematic illustration of a laser oxide removal process that is followed immediately by electroplating via an exemplary conveyor.

FIG. 5 depicts a reel-to-reel plater system (500) in which ablation is followed by electroplating. As in FIG. 4, a laser (10), focal lens (20), front window of a container (25), substrate with a native oxide layer (30), supply reel (80) and guides (90) are provided. The laser is spaced such that it contacts the substrate just above the top surface of a solution (110) that prevents re-oxidation of the substrate, such that the spacing is just large enough to prevent wicking/wetting onto the substrate. Solution (110) can contain an electrolyte to provide electroless plating or an electrolyte to provide immersion plating.

After being laser ablated and immersed into solution (110) the substrate is introduced to an electroplating tank containing an electrolyte solution (40), which is provided with an anode or counter electrode (60). The substrate is in sliding contact with a cathode such that the substrate itself forms a cathode. After electroplating, the substrate is directed to a take-up reel (110) or to a rinse tank prior to being directed to the take-up reel.

Figure 6:
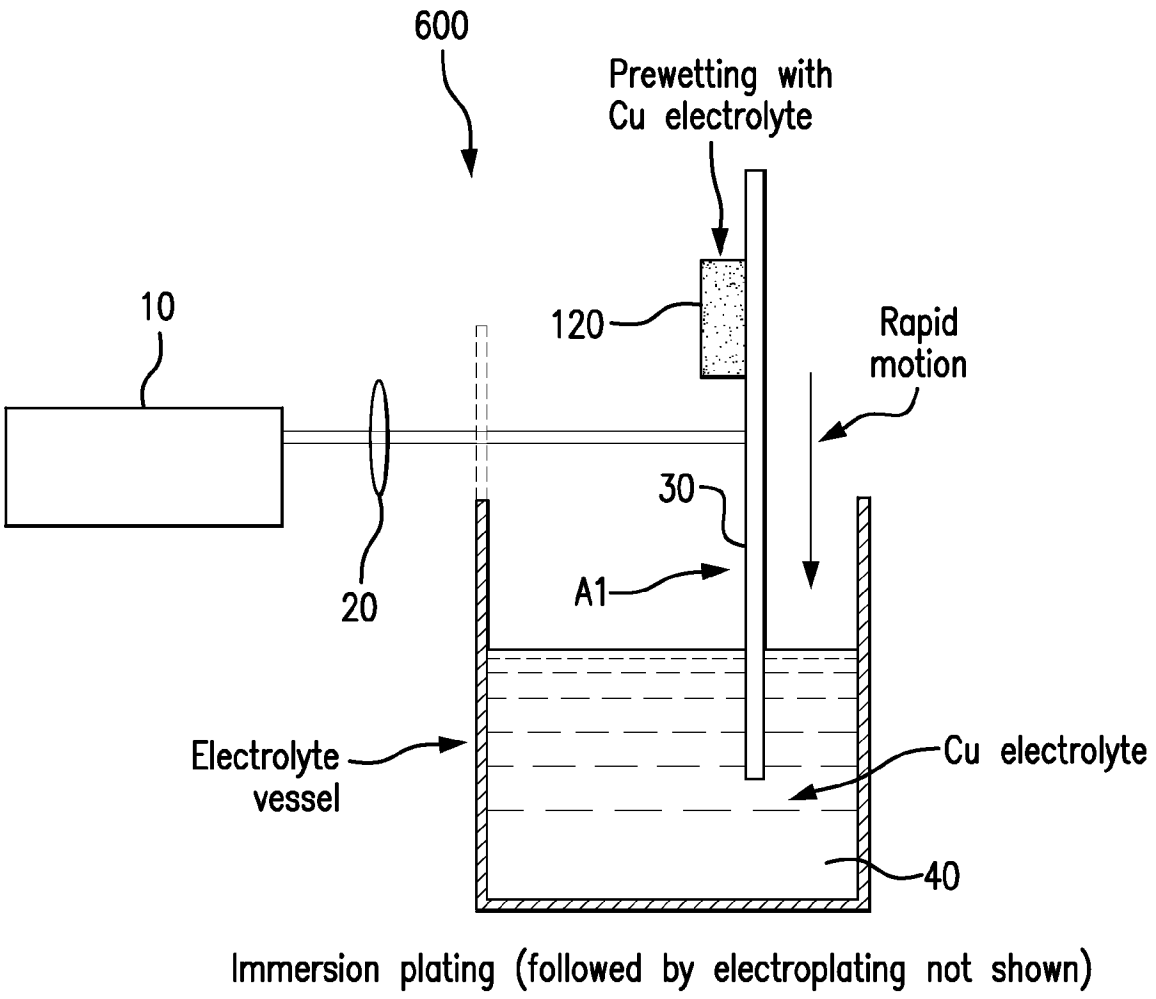
FIG. 6 is a schematic illustration of a laser oxide removal process that includes a pre-wetting procedure via a wetting pad, followed by ablation that is in turn followed immediately by immersion plating.

FIG. 6 provides a system (600) according to an alternative aspect of the presently disclosed subject matter, in which the substrate (e.g., an aluminum substrate) is pre-wetted with an electrolyte (e.g., a copper electrolyte) prior to being contacted with a laser (10). The electrolyte is introduced to the substrate (30) via a wetting pad (120) (e.g. a sponge or the like) which is in fluid communication with a source of electrolyte (not shown) such that the electrolyte is constantly replenished. In this embodiment, the substrate is introduced to a second electrolyte source (40), although this step is optional and can be omitted. In certain embodiments, the electrolyte is the same as that which is provided by the wetting pad 120. In that case only immersion plating has occurred. The electrolyte vessel or container can contain a counter electrode so that electroplating can be made to occur in the region where the sample was wetted by the wetting pad. Furthermore, the substrate can optionally then be introduced to an electroplating step (not shown).

Figure 7:
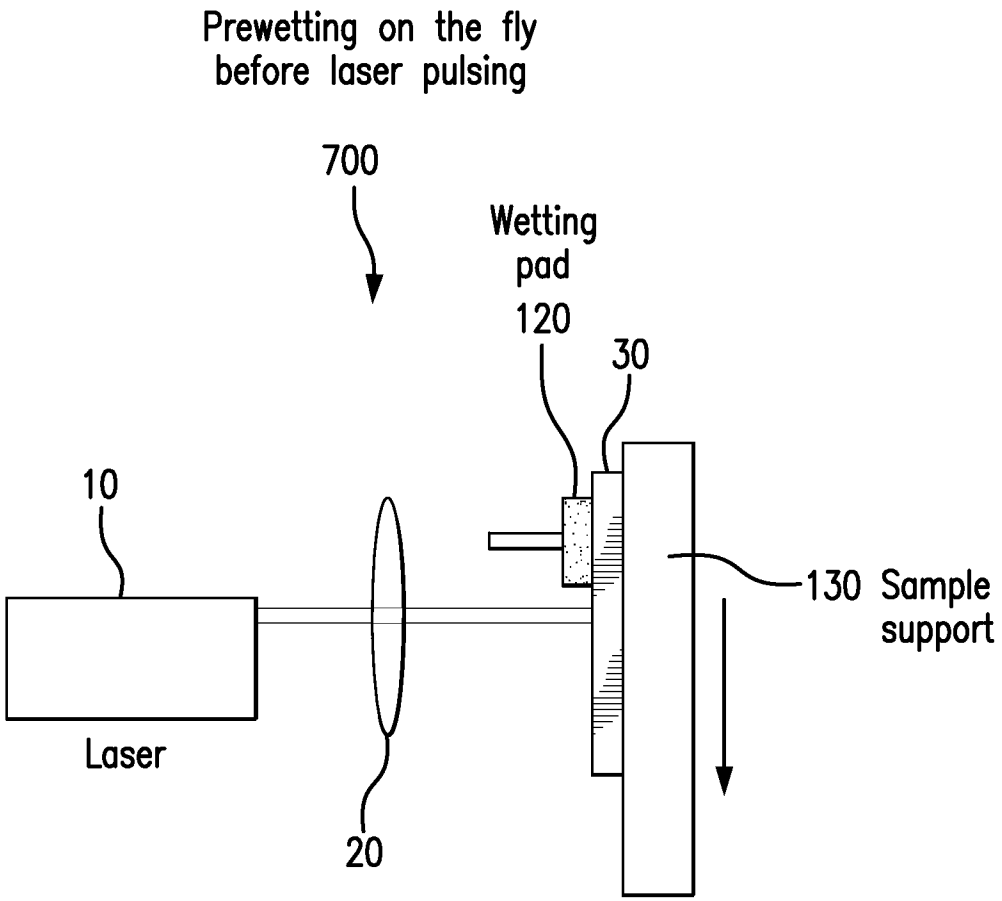
FIG. 7 is a schematic illustration of a laser oxide removal process that employs a pre-wetting step via a wetting pad.

FIG. 7 depicts a system (700) also involving pre-wetting the substrate (30) with an electrolyte wetting pad (120) prior to be contacted with the laser (10) via focal lens (20) to ablate the native oxide layer and allow the electrolyte to be applied thereon. In this embodiment, a sample support (130) is provided to maintain optical alignment, with respect to the incident laser beam.

Figure 8:
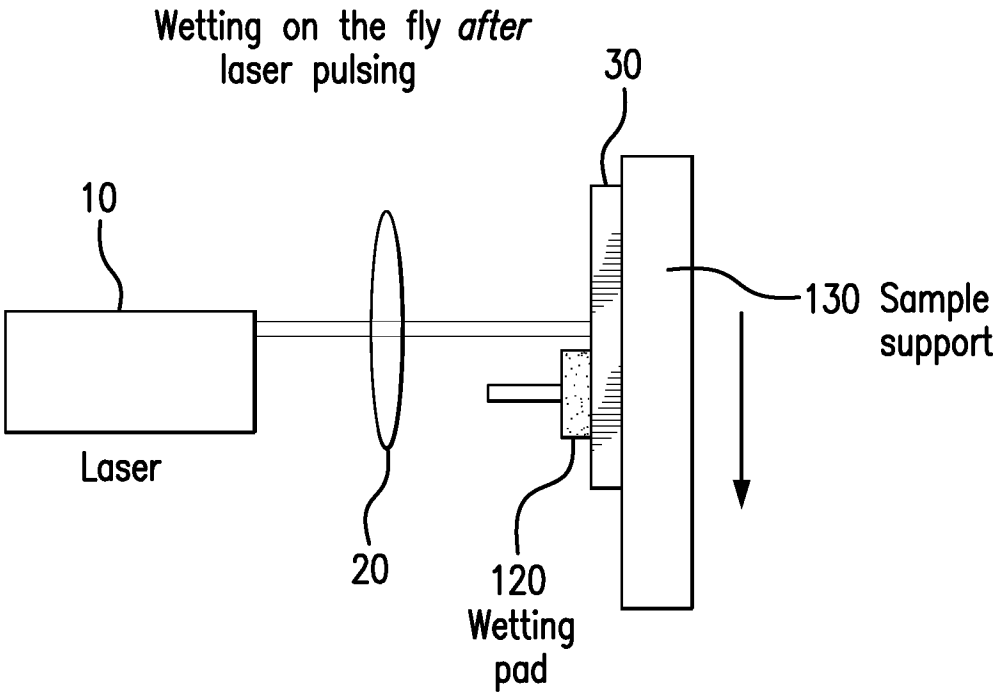
FIG. 8 is a schematic illustration of a laser oxide removal process that employs a wetting step after laser ablating the substrate.

As shown in FIG. 8, alternatively, the wetting pad (120) can be employed to immerse the ablated dry substrate in electrolyte after the substrate is contacted with the laser (10). Accordingly "immersion," as used herein, can be achieved, for example, by introducing the substrate to a solution of electrolyte, or by applying a wetting pad that contains the electrolyte to the substrate, even if the electrolyte layer that is applied to the substrate has a thickness of a few nanometers (e.g., 200 nm or thicker). A sample support (130) is also provided, as-in FIG. 7.

Figure 9:
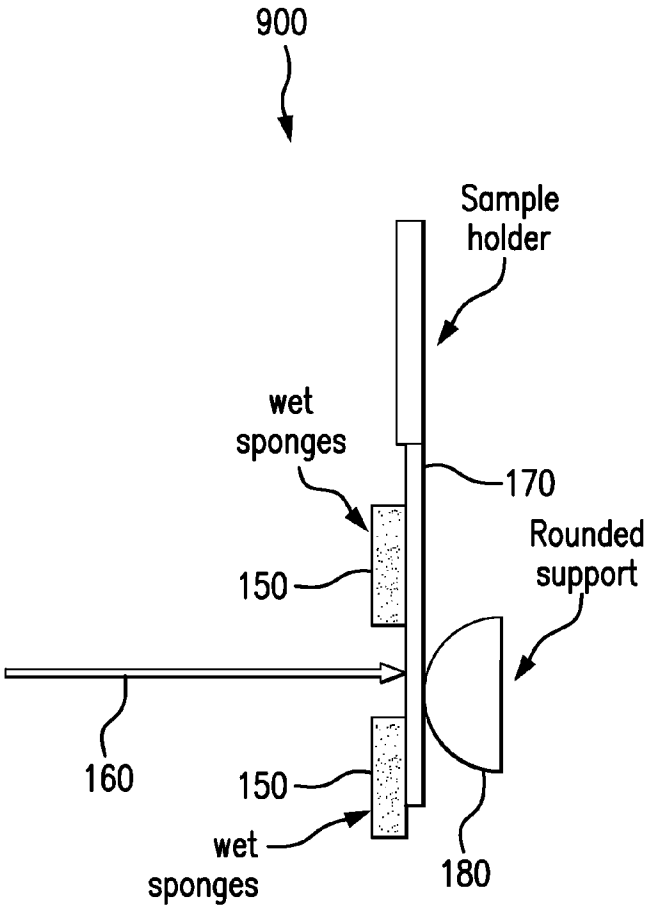
FIG. 9 is a schematic illustration of a laser oxide removal process that employs a wetting step both before and after laser ablating the substrate.

FIG. 9 depicts a system (900) according to yet another embodiment of the presently disclosed subject matter. In this particular embodiment, a wetting pad (e.g., a fine wet sponge (150)) is employed both before and after the laser beam (160) ablates the substrate (170). Alternatively, the wetting pad can be a wicking material, commercial sponge, gauze or the like.

This embodiment also provides a rounded support (180) for the substrate, which can be preferred over other shapes of sample supports to reduce deformation and to ensure a flush point of contact with the substrate at the point of ablation with the laser beam. The sample holder can be an electrically conducting tube or rod with a clamp to hold the sample. However, the same configuration can be used in conjunction with a reel to reel system.

In this particular embodiment, the sample is pre-wetted, introduced to a laser beam, and then wetted again to increase the exchange/immersion plating. All samples deform or are displaced to some degree from the resulting shock wave caused by the laser beam impingement on the sample, especially thin samples, i.e., samples of 10 mil thickness or less. For example, a 10 mil sample can deform approximately five times as much when ablated in a wet form, as compared to dry ablation under similar laser strikes due to the differences in shock wave which also causes a displacement in space. The rounded support reduces the movement of the sample.

Figure 10:
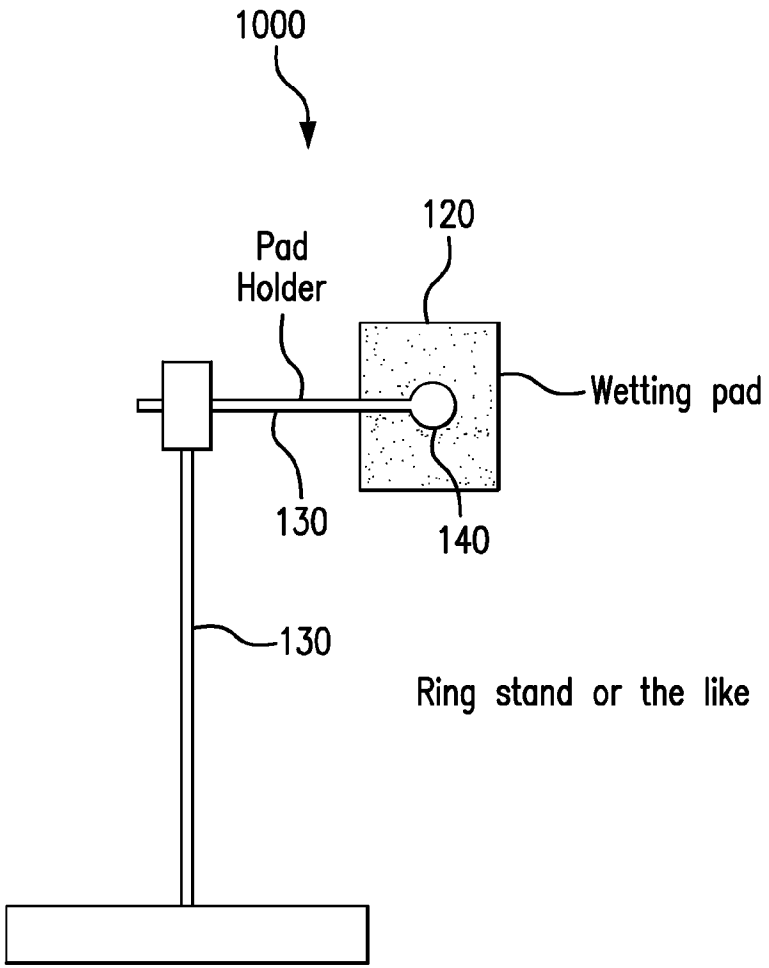
FIG. 10 discloses an exemplary support device that can be used in conjunction with the presently disclosed methods and systems.

FIG. 10 depicts an exemplary apparatus (1000) which can be used to engage the wetting pad (120) with the substrate (not shown). A ring stand (130) is provided with a pad holder (140). The wetting pad is in fluid communication with a source of electrolyte, via, for example, tubing and a pump (not shown) to introduce the electrolyte solution from the source to the wetting pad.

Any ion can be plated with or without a front window indicated by a dotted line in the Figures above (part of the container). Both configurations can be used with, or without, a pre-wetting step.

Attenuation of the laser beam is eliminated or greatly reduced when the beam does not pass through a thick layer of electrolyte, since the beam either does not pass through the electrolyte, or passes through a very thin layer of the electrolyte. This increases the power usage available for oxide removal making it possible to use complicated electrolytes (e.g., Technosol Ag RUT™ electrolyte, etc., or electrolytes which are a) opaque to the laser and/or b) decompose with laser light. The method also provides a configuration that eliminates the need for pre-wetting of the substrate.

The disclosed subject matter provides a Laser Oxide Removal for Plating (LORP) process which, in one embodiment, includes a laser, an electrolyte solution and a substrate, in which the laser travels a very short distance (e.g., several microns) through the electrolyte before contacting the substrate, thereby ablating or removing the natural oxide layer on the substrate, to enable adherent plating. In other words, a thin electrolyte layer is provided whereby laser attenuation is reduced, as compared to previously disclosed embodiments using known LORP processes. The thin electrolyte layer can be provided, for example, by applying the electrolyte solution to the substrate with a wetting pad such as a sponge, preferably a fine sponge, or other porous material in the form of a moistened roller in contact with the moving substrate. This has been experimentally demonstrated using a wetted a Q-Tip™ while the substrate is in motion. In one embodiment, the electrolyte layer is from about 200 nm to about 600 nm thick. Laser wavelengths spanning the range from the infrared to the UV range can be used to cause the ablation.

The disclosed subject matter also provides a second embodiment using a laser for the ablation of a dry substrate in a normal air environment, in combination with an electrolyte solution into which the ablated substrate is immersed within a very short time, preferably less than 1 s, after ablation. The ablation occurs above the surface of the electrolyte while the substrate moves toward the surface of the electrolyte. Such an embodiment eliminates the need for pre-wetting the substrate.

In one embodiment, the distance between where the laser (e.g., a femtosecond, picosecond, nanosecond, millisecond pulsed laser or even a cw laser in the range of wavelengths from far infrared to deep ultraviolet) strikes the substrate and the surface of the electrolyte solution (e.g., the surface of Technosol Ag RUT™ electrolyte solution) is just large enough to prevent wicking/wetting onto the substrate. In one embodiment, the distance between where the laser strikes the substrate and the surface of the electrolyte solution is from about 5 mm to about 15 mm (e.g., 10 mm). In another embodiment, the time between which the laser ablated region first reaches the electrolyte after ablation is small, (e.g., <~1 second, alternatively <than ~100 ms).

Plating is an important materials processing technique which enables coating of conducting substances with metals. Such a process is used in aerospace, electronics and manufacturing industries to enhance existing properties or give new properties to materials such as reflectivity, corrosion resistance, wear resistance and aesthetic appeal. Some metals such as aluminum (also Ti, W, stainless steel) have a native oxide layer which is spontaneously formed on the surface, once exposed to air, which changes the physical surface properties. Such metals can be efficiently plated after removal of the oxide layer. Here, novel improvements are provided over previously reported Laser Oxide Removal for Plating (LORP) processes; see, e.g., International Published Application No. WO2006/086407 and U.S. Pat. No. 4,283,259 each of which is hereby incorporated by reference in its entirety. LORP processes reduce the preprocessing needed to plate metals as well as making the process of removing oxide and plating simultaneous or near simultaneous. The presently disclosed methods and systems enhance previously disclosed process by reducing laser damage to the electrolytes, reducing wastage of consumed electrolytes, and increasing the efficiency of the laser for the purpose of oxide removal.

LORP has demonstrated the ability to simultaneously remove oxide from aluminum followed by plating nickel, copper, silver and the like. It reduces the pre-processing normally required for plating. The reduction in pre-processing also results in elimination of many potentially environmentally harmful chemicals. LORP eliminates the need to handle the materials between stages of oxide removal and plating.

Certain embodiments of the disclosed subject matter which involve use of a wetting pad provide relatively small, if not negligible electrolyte attenuation since the applied electrolyte is only several microns thick. Providing only a thin electrolyte layer makes it possible to use a number of electrolytes that are too attenuating using previously disclosed LORP schemes. Furthermore, if the laser causes deterioration of the electrolyte, the use of a wetting pad consumes a very small quantity of electrolyte so that waste is reduced.

The presently disclosed subject matter need not necessarily use a window through which the light must pass in order to reach the substrate thereby simplifying structure and cost. Highly focused lasers damage most windows, thus in previously disclosed embodiments the laser must be relatively unfocused before entering the cell. In that case, to achieve focus, the light must pass through a long length of electrolyte which causes strong attenuation, diminishing the strength of the laser incident on the sample for oxide removal.

The use of a long focal length lens, in certain embodiments, can be advantageous as it gives a large depth of focus and prevents any cell window, if used, from becoming splashed due to the LORP process. If no window is used, the present process prevents the lens used to focus the light from the laser from becoming splashed since the distance between lens and laser can be made arbitrarily large. One implementation, as already described, is to wet a porous or sponge-like material in contact with the substrate undergoing oxide removal and plating. This can cause desired immersion (exchange) plating. The strip/substrate can then be passed into a second tank for plate-up via electroplating. The resulting deposited films are found to be adherent. Alternatively, electroplating can occur in one tank so that there is no need for an additional immersion plating process In that case, there is a counter electrode in the first and only plating tank to provide the desired deposition.

In embodiments where the substrate is ablated in air and rapidly submerged, and also in embodiments in which the substrate is prewetted to cause immersion plating, only one plating tank is required. The electrolyte in that tank can be the same electrolyte as the prewetted electrolyte, or alternatively, can also be electroless. The first tank can be any electrolyte for electroplating. In such circumstances, the pre-wetted sample should be dry before entering the tank if the electrolyte is different from that of the pre-wetting electrolyte to avoid contamination of the electrolyte tank.

Other embodiments of the disclosed subject matter also provide single process plating of oxide coated materials. In embodiments where a porous or sponge-like material is wetted and placed in contact with the substrate undergoing oxide removal by way of the laser strike, immersion plating will occur if the ions in the electrolyte are more 'noble' than the substrate. This film is adherent and can be further plated up by a second metal in a tank with a counter electrode.

Using a thin (several microns thick) electrolyte layer, the laser beam is not attenuated significantly. This allows the use of many electrolytes which are otherwise too attenuating to be used for LORP and reduces wastage of electrolytes. This configuration can also be made to obviate the need for a laser window through which the laser passes making the laser strike more efficient.

The disclosed subject matter simplifies the structure and increases the reliability of LORP processes. Without a front window through which the laser must pass, the cost and reliability of the process is improved. Long focusing lengths which are required in order to not damage the laser window can be avoided. For the same laser output power a thin layer of electrolyte yields a higher amount of laser power/area is available leading to a greater area of oxide removal for a given laser pulse.

Dry Substrate Laser Ablation

In alternative embodiments, the laser can be made to strike the substrate in a dry condition above the electrolyte. With proper adjustment of speed of the motor driving the substrate into the electrolyte, re-oxidation of the metal can be avoided or at least considerably reduced. With this technique several previously unusable electrolytes, which otherwise deteriorate rapidly on exposure to the laser, can be used for coating.

Even with a slow stepping motor (e.g., at max speed, ~½ cm/s), the time between laser strike in air, as illustrated in the Figures, and the substrate reaching the bath is sufficiently short to allow for immersion plating to take place (no significant re-oxidation). Therefore, ionic metals that are more noble than Al can be used to displace Al, thereby causing a thin plated layer of the more noble metal on the Al using either the window or windowless configurations. Also, for example, Technosol Ag RUT™ electrolyte can be plated on Al using the windowless configuration followed by silver plateup without pre-wetting the Al. The previously disclosed method in which the laser passes through the electrolyte does not allow for silver deposition on Al as the Technosol Ag RUT™ electrolyte rapidly deteriorates with the passage of focused laser light through the solution. With the present technique, the silver electrolyte never comes in contact with the laser.

This plating capability can be used, for example, for copper, nickel and silver depositions with arbitrarily thick (e.g., 10 mil) Al (or Ti, W, stainless) substrates with a laser strike in air just above the liquid level as the sample is moved down into the electrolyte within about ~½ second after the strike. For a reel to reel plater, the speed can be 10 to 100 times faster than obtainable with existing setups. The major application of this new set of LORP configurations is especially suitable for reel-to-reel plating systems, such as, but not limited to, the systems described in the Figures.

Enough space should be maintained between the beam strike position and the level of the electrolyte to prevent substrate wetting by wicking or surface tension effects. In windowless embodiments, the substrate should be dry for the laser strike in air prior to lowering the sample into the electrolyte.

The disclosed subject matter demonstrates that substrates, (e.g., Al) do not re-oxidize sufficiently rapidly in several seconds to prevent adherent plating. While not being bound by any particular theory, it is believed that some re-oxidation likely occurs immediately, but it appears to be insignificant with respect to the ability to achieve adherent depositions.

Applications

A direct application of this technology is for plating aluminum and other metals which are difficult to coat unless the native oxide layers are removed. The procedure is also applicable for plating highly doped semiconductors with a natural oxide layer. Applications can further include, but are not limited to, maskless pattern definition, connectors for the microprocessor industry, surface modification of steel and other metals for corrosion resistance, MEMS multilayer fabrication, gold/silver/platinum plating for low cost jewelry and art, activated surfaces for chemical reactions, such as carbon nanotube growth, and thermal interfaces using copper thin films for enhanced heat transfer between metal cooling components for semiconductor chips.

The presently disclosed subject matter is not to be limited in scope by the specific embodiments described herein.

Indeed, various modifications of the disclosed subject matter in addition to those described herein will become apparent to those skilled in the art from the foregoing description and the accompanying figures. Such modifications are intended to fall within the scope of the appended claims.

It is further to be understood that all values are approximate, and are provided for description.

Patents, patent applications, publications, product descriptions, and protocols are cited throughout this application, the disclosures of each of which is incorporated herein by reference in its entirety for all purposes.

The invention claimed is:

1. A system for use in the ablation of the surface of a substrate using a first plating solution source and a second plating solution source, comprising:

(a) a laser to provide a laser beam;

(b) a substrate having a native oxide layer on a surface thereof; and (c) a conveyor to direct the substrate towards the first plating solution source and from the first plating solution source to the second plating solution source; and (d) a support block configured to reduce movement of the substrate from the laser beam impingement on the substrate, wherein the laser and substrate are configured such that the laser beam contacts the substrate in a dry form in air to at least partially remove the native oxide layer prior to the substrate being introduced to the first plating solution source, and wherein the conveyor is adapted to direct the substrate at a speed to reduce re-oxidation of the substrate between where the laser beam strikes the substrate and the first plating solution source.

2. The system of claim 1, wherein the first plating solution source comprises a first container of the plating solution and the second plating solution source comprises a second container of the plating solution.

3. The system of claim 2, wherein the first container of the plating solution includes a plating solution air interface, and the distance between where the laser beam strikes the substrate and the plating solution air interface is from 5 mm to 15 mm.

4. The system of claim 1, wherein the first plating solution source comprises a first wetting pad and the second plating solution source comprises a second wetting pad.

5. The system of claim 4, wherein the distance between where the laser beam strikes the substrate and the first wetting pad is from 5 mm to 15 mm.

6. A system for use in the ablation of the surface of a substrate comprising:

(a) a laser to provide a laser beam;

(b) a substrate having a native oxide layer on a surface thereof;

(c) a first wetting pad that includes an plating solution and a second wetting pad that includes the plating solution;

(d) a support block configured to reduce movement of the substrate from the laser beam impingement on the substrate; and (e) a conveyor to direct the substrate towards the first wetting pad and from the first wetting pad to the second wetting pad;

wherein the laser and substrate are configured such that the laser beam contacts the substrate after a thin layer of the plating solution is deposited on the substrate by being introduced to the first wetting pad to at least partially remove the native oxide layer and prior to the substrate being introduced to the second wetting pad, and wherein the conveyor is configured to direct the substrate at a speed to reduce re-oxidation of the substrate between where the laser beam strikes the substrate and the second wetting pad.

7. The system of claim 6, wherein the first and second wetting pads are each configured to deposit the plating solution on the substrate at a thickness of from 200 nm to 10 microns.

* * * * *